US007297176B2

(12) United States Patent
Ouchterlony

(10) Patent No.: US 7,297,176 B2
(45) Date of Patent: Nov. 20, 2007

(54) CEMENTED CARBIDE BODY

(75) Inventor: Hèléne Ouchterlony, Ingarö (SE)

(73) Assignee: Sandvik Intellectual Property AB, Sandviken (SE)

( * ) Notice: Subject to any disclaimer, the term of this patent is extended or adjusted under 35 U.S.C. 154(b) by 322 days.

(21) Appl. No.: 11/042,213

(22) Filed: Jan. 26, 2005

(65) Prior Publication Data

US 2005/0211016 A1 Sep. 29, 2005

(30) Foreign Application Priority Data

Jan. 26, 2004 (SE) ..... 0400141

(51) Int. Cl.
*C22C 29/02* (2006.01)

(52) U.S. Cl. ..... 75/236; 51/307

(58) Field of Classification Search ..... 75/236, 75/241, 242; 51/307, 309
See application file for complete search history.

(56) References Cited

U.S. PATENT DOCUMENTS 4,451,292 A * 5/1984 Hall et al. ..... 75/238
4,708,037 A 11/1987 Bulhan et al.
5,403,628 A * 4/1995 Konig et al. ..... 427/569
5,786,069 A 7/1998 Ljungberg et al.
6,062,776 A 5/2000 Sandman et al.
6,071,469 A * 6/2000 Rohlin et al. ..... 419/14
6,086,980 A 7/2000 Foster et al.
6,221,479 B1 4/2001 Waldenstrom et al.
6,228,139 B1 * 5/2001 Oskarsson ..... 75/240
6,229,992 B1 * 5/2001 McGeehan et al. ..... 455/78
6,250,855 B1 * 6/2001 Persson et al. ..... 407/119
6,541,135 B1 * 4/2003 Ederyd et al. ..... 428/698
2003/0010166 A1 * 1/2003 Shibata ..... 83/13
2003/0129456 A1 7/2003 Usami et al.
2005/0092276 A1 * 5/2005 Ritter ..... 123/90.51

FOREIGN PATENT DOCUMENTS

JP 60-43459 * 3/1985
JP 1-156439 6/1989
JP 10-140204 5/1998

* cited by examiner

*Primary Examiner*—Roy King
*Assistant Examiner*—Ngoclan T. Mai
(74) *Attorney, Agent, or Firm*—Drinker Biddle & Reath LLP

(57) ABSTRACT

The present invention relates to a cemented carbide body with the following composition: Co: 10-12 wt-%, TaC: <3 wt-%, NbC: 1-5.5 wt-%, TiC: 3-5 wt-% and as rest WC. The cemented carbide body is particularly useful for metal cutting operations requiring high wear resistance, high edge retention and high edge toughness.

21 Claims, 2 Drawing Sheets

CEMENTED CARBIDE BODY

BACKGROUND OF THE INVENTION

The present invention relates to a cemented carbide body for use in, e.g., twist drills, particularly useful for metal cutting operations requiring high wear resistance such as drilling in cast iron, etc.

Drilling in metals is generally divided into two types: long hole drilling and short hole drilling. Short hole drilling is generally meant drilling to a depth of up to 3-5 times the drill diameter.

Long hole drilling places great demands on good chip formation, lubrication, cooling and chip transport. This is achieved through specially developed drill systems with specially designed drill heads attached to a drillstring. The drill head can be of solid cemented carbide but is generally of tool steel provided with a number of inserts of cemented carbide placed in such a way that they together form the cutting edge.

With short hole drilling, the demand is not as great and twist drills either of cemented carbide, tool steel or tool steel provided with cemented carbide inserts are used.

A twist drill of cemented carbide is usually manufactured from a cylindrical blank which is machined to the desired shape and dimensions particularly to form cutting edges and flutes. Alternatively, the chip flutes are at least preformed during the extrusion operation. As a result of the grinding, sharp edges are formed.

A relatively recent type of drill is a drill with an exchangeable drill tip generally made of cemented carbide and removably connected to a drill shank of tool steel.

A common reason to failure of a twist drill is excessive wear in the juncture between the main cutting edge and the leading edge. Another reason to failure is, when the cutting speed is increased, plastic deformation due to high temperature in the peripheral part of the cutting edge.

EP-A-951576 discloses a cemented carbide drill consisting of a tough core surrounded by a more wear resistant cover. This type of drill is most suitable for toughness demanding drilling applications.

OBJECTS AND SUMMARY OF THE INVENTION

It is an object of this invention to avoid or alleviate the problems of the prior art.

It is also an object of this invention to provide a cemented carbide body having high wear resistance.

It is a specific object of the present invention to provide a metal drilling tool with increased tool life in applications requiring good wear resistance.

In one aspect of the invention, there is provided a cemented carbide body of the following composition:

Co: from about 10-12 wt-%,

TaC: <3 wt-%,

NbC: from about 1.5-5.5 wt-%,

TiC: from about 3-5 wt-% and

WC: as remainder.

In another aspect of the invention, there is provided the use of the above-defined body as a rotary tool for metal machining.

DETAILED DESCRIPTION OF THE PREFERRED EMBODIMENTS OF THE INVENTION

It has now surprisingly been found that a cemented carbide with the following composition gives excellent results in drilling operations requiring good wear resistance without suffering from plastic deformation and/or thermal cracking.

Co: from about 10-12, preferably from about 10.5-11.5 wt-%,

TaC: <3, preferably from about 1-3, most preferably from about 1.8-2.3 wt-%,

NbC: from about 1-5.5, preferably from about 2.5-5.5, most preferably from about 3.5-5 wt-%, TiC: from about 3-5, preferably from about 3.8-4.3 wt-% and WC: as rest, preferably from about 76-81, most preferably from about 77-79 wt-%.

TaC+TiC+NbC: preferably from about 8-13, most preferably from about 9-12 wt-%.

V and/or Cr: preferably <1 wt-%.

In an alternative embodiment particularly for metal sawing tips: Co and W as above, TaC: <2, preferably about 0 wt-%, NbC: from about 4 to about 6, preferably 5<NbC+TaC<7 wt-% and NbC+TaC: from about 5 to about 7 wt-%.

The average grain size of the WC is from about 0.4-1.5, preferably 0.8-1.5, most preferably about 1, μm determined using linear analysis on a representative number of SEM micrographs.

The hardness of the cemented carbide is from about 1450 to 1650, preferably 1450-1550, HV.

The body is provided with a wear resistant coating as known in the art such as PVD-TiN, PVD-TiAlN or CVD coating.

The body according to the invention can be made with conventional powder metallurgical techniques of milling of powder, forming hard constituents and binder metal, pressing or extruding the milled mixture to cylindrical blanks which are sintered and finally ground to desired shape and dimensions after which the drill is provided with a wear resistant coating as known in the art.

The present invention also relates to the use of a cemented carbide according to above as a rotary tool for metal machining such as a solid carbide twist drill, a twist drill with exchangeable tip or an end mill, hob, circular knife or hollow circular cutter for metal thread/rod shaping, in particular at a peripheral speed of >150 m/min.

The present invention further relates to the use of a cemented carbide according to the above as a rotary tool for metal machining such as, hob, circular knife, hollow circular cutter for metal thread/rod shaping, in particular a saw tip for a metal saw for metal cutting/sawing at a peripheral speed of >750 m/min or as a wear part especially for metalforming tools, e.g., canning tools.

The invention is additionally illustrated in connection with the following Examples which are to be considered as illustrative of the present invention. It should be understood, however, that the invention is not limited to the specific details of the Examples.

EXAMPLE 1

Figure 1:
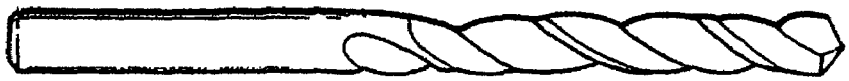
FIG. 1 shows a twist drill.
Figure 2:
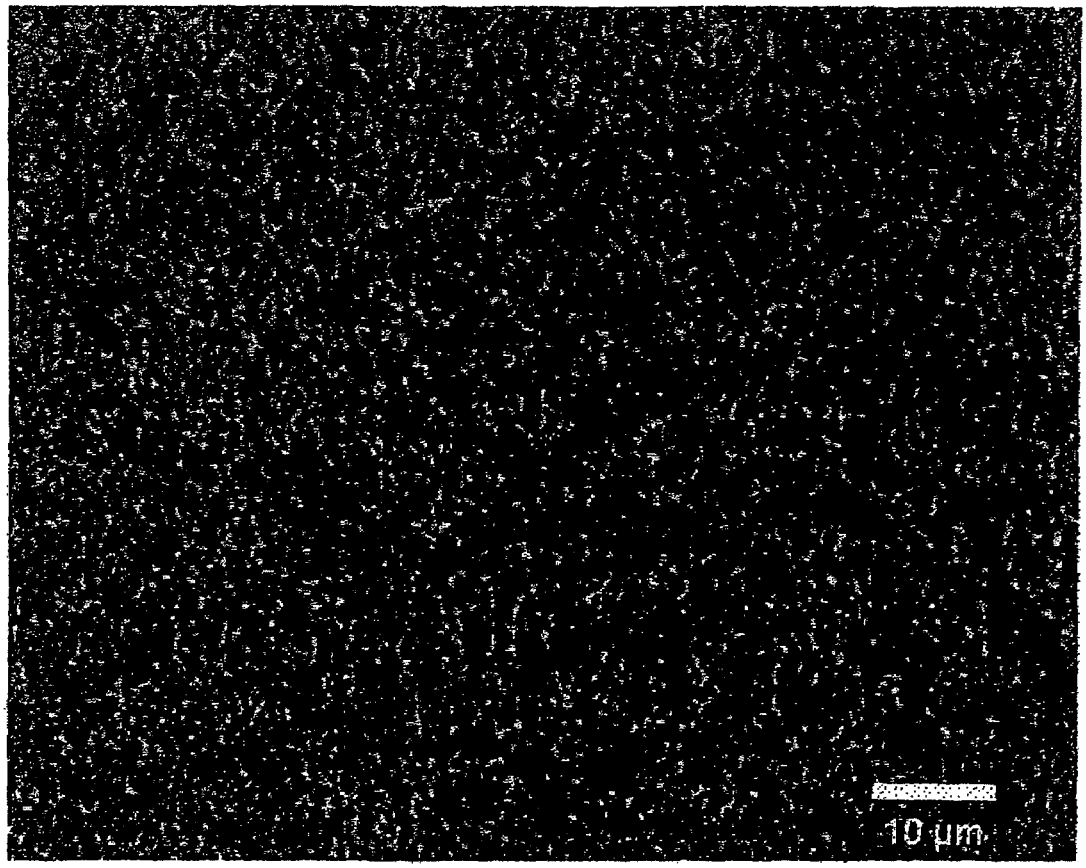
FIG. 2 shows in about 1200× magnification the microstructure of the cemented carbide according to the invention.

Samples were prepared by wet mixing powders of WC, Co, TiC, TaC and NbC to obtain a cemented carbide with a composition of 78.2 wt-% WC, 11.2 wt-% Co, 4.0 wt-% TiC, 2.1 wt-% TaC, 4.5 wt-% NbC and an average WC grain size of about 1 μm. The mixture was, after spray drying, isostatically pressed to cylindrical blanks which were ground to drills of 8 mm diameter. The microstructure is shown in FIG. 2. After grinding the drills were coated with a layer of 4 μm TiAlN using PVD-technique.

EXAMPLE 2

Drills from Example 1 were tested in a drilling operation for drilling through holes in cast iron SS0125. As a reference, corresponding drills of Sandvik commercial cemented carbide grade GC 1220 commonly used for drilling in cast iron.

The following data were used:

Cutting speed: 100 m/min

Feed: 0.25 mm/rpm

Through holes, 25 mm deep, were drilled with outer coolant.

Figure 3:
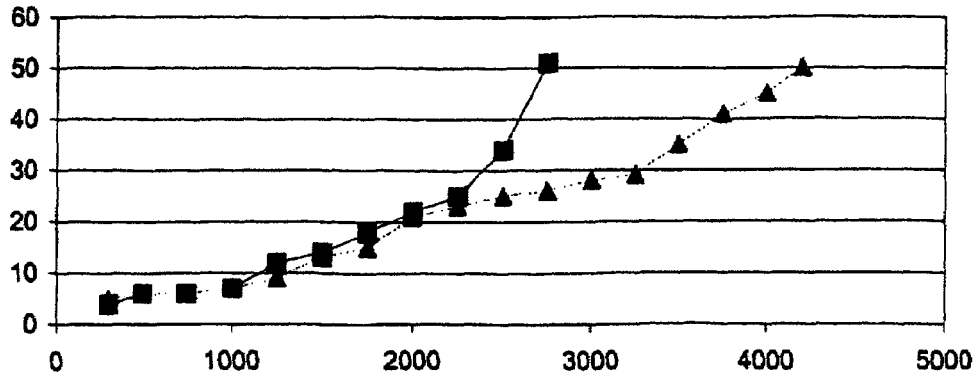
FIG. 3 shows the wear development in a performance test of a twist drill according to the present invention (▲) and according to prior art (■).

The result is presented in FIG. 3 which shows the wear VBPmax as a function of number of holes drilled for the drill according to the invention (▲) and reference (■).

EXAMPLE 3

Example 2 was repeated at an increased cutting speed of 175 m/min and internal cooling.

Figure 4:
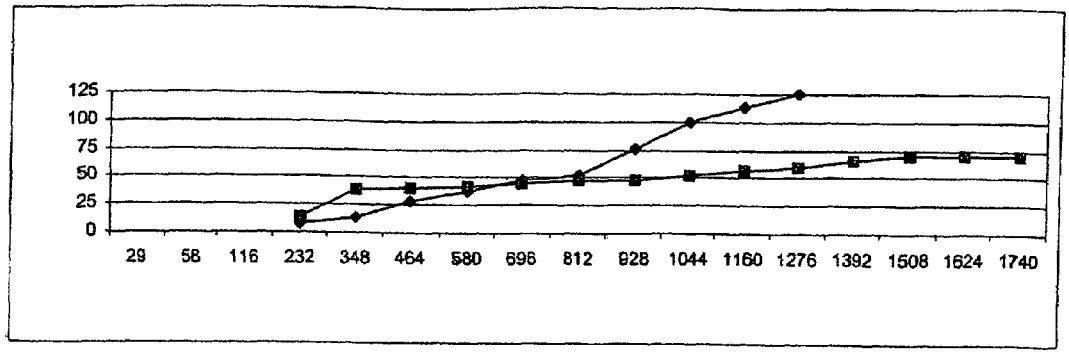
FIG. 4 shows the wear development in a performance test of a twist drill according to the present invention (■) and according to prior art (♦).

The result is presented in FIG. 4 which shows the wear VBPmax as a function of number of holes drilled for the drill according to the invention (■) and reference (♦).

Examples 2 and 3 show that the composition of the present invention is between 35% and 50% better in wear resistance in both ordinary and increased cutting speeds.

EXAMPLE 4

Samples were prepared by wet mixing powders of WC, Co, TiC, CrC and NbC to obtain a cemented carbide with a composition of 78.8 wt-% WC, 11.2 wt-% Co, 4.0 wt-% TiC, 5.5 wt-% NbC, 0.5 wt-% CrC and an average WC grain size of about 1 μm. The mixture was, after spray drying, uniaxially pressed and sintered to saw tip blanks.

EXAMPLE 5

A circular saw blade was made of tips from Example 4. Saw tips of a commodity cemented carbide grade with the composition of 69 wt-% WC, 11 wt-% Co, 10 wt-% TiC, 8.5 wt-% TaC, 1.5 wt-% NbC and an average WC grain size of about 2.0 μm was used as reference material. All saw tip blanks were brazed onto a circular steel blade (ϕ 285 mm×60 tips) and ground to a width of 2.5 mm. The edge of each tip had a ground chamfer of width 0.2 mm. The tips were placed onto the saw in groups of six tips for each variant.

The cutting test material was steel bar type 17Cr3, Ø 52 mm. The reference cemented carbide grade is commonly used in circular metal saws for general steel, low carbon steel and stainless steel.

The following data were used in the dry saw cutting test:

Machine: Noritake

Cutting speed: 800 rpm

Feed rate: 40 mm/s

Machinability additive: Supra 60S with a dropping speed of 1 drop/second

The saw tip performance was measured by the flank wear after 10000 passes.

Result:

The saw tips of the reference grade showed a flank wear of 0.4 mm after 10000 cuts.

The saw tips according to the invention had less than 0.15 mm of flank wear.

Microchipping along the cutting edge with severe built-up edge (BUE) and heavy smearing could be observed at the edges of the reference grade.

The saw tips according to the invention showed a nice wear pattern with good edge retention without micro chipping.

Example 5 shows that the flank wear resistance is more than two times higher in the invented grade.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. Cemented carbide body of the following composition:

Co: from about 10.5-11.5 wt-%,

TaC: <3 wt-%,

NbC: from about 3.5-6 wt-%,

TiC: from about 3-5. wt-% and

WC: as remainder, wherein the average grain size of the WC is from about 0.4-1.5 um, and wherein said body is a rotary tool for metal machining.

2. The cemented carbide body of claim 1 wherein the amount of TaC+TiC+NbC is from about 8-13 wt-%.

3. The cemented carbide body of claim 1 wherein the WC-content is from about 77-79 wt-%.

4. The cemented carbide body of claim 1 wherein said body has a hardness of from about 1450-1650 HV.

5. The cemented carbide body of claim 4 wherein said body has a hardness of from about 1450-1550 HV.

6. The cemented carbide body of claim 1 wherein the body is provided with a thin wear resistant coating.

7. The cemented carbide body of claim 1 wherein said rotary tool for metal machining is a solid carbide twist drill, a twist drill with exchangeable tip or an end mill, hob, circular knife or hollow circular cutter for metal thread/rod shaping.

8. The cemented carbide body of claim 1 having the following composition:

TaC: 1.8-2.3 wt-%,

NbC: 3.5-5 wt-%,

TiC: 3.8-4.3 wt-% and

WC: as remainder.

9. The cemented carbide body of claim 1 wherein the amount of TaC+TiC+NbC is from about 9-12 wt-%.

10. The cemented carbide body of claim 8 wherein the amount of TaC+TiC+NbC is from about 9-12 wt-%.

11. The cemented carbide body of claim 8 wherein the WC-content is from about 77-79 wt-%.

12. The cemented carbide body of claim 1 wherein the average grain size of the WC is about 1 μm.

13. The cemented carbide body of claim 1 wherein:

TaC: <2 wt-%,

NbC: from about 4-6 wt-%, and

NbC+TaC: from about 5-7 wt-%.

14. The cemented carbide body of claim 8 wherein the average grain size of the WC is about 1 μm.

15. The cemented carbide body of claim 13 wherein:

NbC:>5 wt-%.

16. A cemented carbide body of the following composition:

Co: from about 10.5-11.5 wt-%,

TaC:<3 wt-%,

NbC: from about 3.5-6 wt-%.

TiC: from about 3-5 wt-% and

WC: as remainder, wherein the average grain size of the WC is from about 0.4-1.5 micron, and wherein said body is a saw tip for a metal saw for the sawing of metal.

17. A cemented carbide body of the following composition:

Co: from about 10.5-11.5 wt-%,

TaC:<3 wt-%,

NbC: from about 3.5-6 wt-%,

TiC: from about 3-5 wt-% and

WC: as remainder, wherein the average grain size of the WC is from about 0.4-1.5 micron, and wherein said body is a canning tool.

18. A method of machining comprising:

removing material from a workpiece with a rotary tool comprising the cemented carbide according to claim 1.

19. The method of claim 18 wherein said rotary tool is a solid carbide twist drill, a twist drill with exchangeable top or an end mill.

20. The method according to claim 18 wherein the rotary tool operates at a peripheral speed of >150 m/mm.

21. The method according to claim 18 wherein said workpiece is cast iron.

* * * * *